US008344179B2

(12) United States Patent
Horton et al.

(10) Patent No.: US 8,344,179 B2
(45) Date of Patent: Jan. 1, 2013

(54) RECLAMATION OF HALIDE-CONTAMINATED FORMATE BRINES

(75) Inventors: Robert L. Horton, Sugar Land, TX (US); Hui Zhang, Sugar Land, TX (US); Morris Arvie, Jr., Houston, TX (US)

(73) Assignee: M-1 L.L.C., Houston, TX (US)

( * ) Notice: Subject to any disclaimer, the term of this patent is extended or adjusted under 35 U.S.C. 154(b) by 374 days.

(21) Appl. No.: 12/671,253

(22) PCT Filed: Jul. 29, 2008

(86) PCT No.: PCT/US2008/071469

§ 371 (c)(1), (2), (4) Date: Jan. 29, 2010

(87) PCT Pub. No.: WO2009/018273

PCT Pub. Date: Feb. 5, 2009

(65) Prior Publication Data

US 2010/0204511 A1 Aug. 12, 2010

Related U.S. Application Data

(60) Provisional application No. 60/953,631, filed on Aug. 2, 2007.

(51) Int. Cl.
*C07C 53/08* (2006.01)

(52) U.S. Cl. ..... 562/607; 210/651

(58) Field of Classification Search ..... None
See application file for complete search history.

(56) References Cited

U.S. PATENT DOCUMENTS

| | | | | |
|---|---|---|---|---|
| 6,015,535 | A * | 1/2000 | Brown et al. | 423/179 |
| 6,177,014 | B1 * | 1/2001 | Potter et al. | 210/651 |
| 7,022,240 | B2 | 4/2006 | Hart et al. | |
| 2004/0209781 | A1 | 10/2004 | Harris | |

FOREIGN PATENT DOCUMENTS

| | | | |
|---|---|---|---|
| WO | 9524452 | A1 | 9/1995 |
| WO | 96/31435 | A1 | 10/1996 |

OTHER PUBLICATIONS

International Search Report from PCT/US2008/071469 dated Dec. 23, 2008 (3 pages).
Written Opinion from PCT/US2008/071469 dated Dec. 23, 2008 (6 pages).
"Formate Brines for Drilling and Completion: State if the Art"; Howard Siv K; SPE Annual Technical Conference and Exhibition, Oct. 22-25, 1995; vol. SPE 30498; May 22, 1995; pp. 483-496 (14 pages).
European Search Report issued in European Application No. 087824488.4 dated Oct. 31, 2011 (9 pages).
Office Action issued in correspondence Eurasian Application No. 201070224 dated Aug. 22, 2011 (4 pages).
Office Action issued in corresponding Canadian Application No. 2,694,910 dated Jun. 21, 2011 (3 pages).
Office Action issued in corresponding Canadian Application No. 2,694,910 dated Feb. 16, 2012 (3 pages).
Examiner's Report issued in corresponding Australian Application No. 2008282288 dated Feb. 1, 2011 (2 pages).

* cited by examiner

*Primary Examiner* — Sudhakar Katakam
(74) *Attorney, Agent, or Firm* — Osha • Liang LLP

(57) ABSTRACT

A method of recovering formate from halide-contaminated formate brine that includes mixing a formate recovery solvent and the halide-contaminated formate brine; separating halide contaminants from the formate; and recovering the formate from the formate recovery solvent is disclosed.

18 Claims, 2 Drawing Sheets

RECLAMATION OF HALIDE-CONTAMINATED FORMATE BRINES

BACKGROUND OF INVENTION

1. Field of the Invention

Embodiments disclosed herein relate generally to wellbore fluids. More specifically, embodiments of the present disclosure relate to the recovery of drilling and completion fluids.

2. Background Art

When drilling or completing wells in earth formations, various fluids typically are used in the well for a variety of reasons. Common uses for well fluids include: lubrication and cooling of drill bit cutting surfaces while drilling generally or drilling-in (i.e., drilling in a targeted petroliferous formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, fluid used for emplacing a packer, abandoning the well or preparing the well for abandonment, and otherwise treating the well or the formation.

Drilling fluids or muds typically include a base fluid (water, diesel or mineral oil, or a synthetic compound), weighting agents (most frequently barium sulfate or barite is used), bentonite clay to help remove cuttings from the well and to form a filter cake on the walls of the hole, lignosulfonates and lignites to keep the mud in a fluid state, and various other additives that serve specific functions.

Historically, the drilling industry has used water-based muds (WBMs) because they are inexpensive. The used mud and cuttings from wells drilled with WBMs can be readily disposed of onsite at most onshore locations. WBMs and cuttings can also be discharged from platforms in many U.S. offshore waters, as long as they meet current effluent limitations guidelines, discharge standards, and other permit limits.

Brines (such as, for example, aqueous $CaBr_2$) are commonly used in WBMs because of their wide density range and the fact that brines are typically substantially free of suspended solids. Brines enhance the performance of WBMs by preventing the hydration, spallation and migration of the resulting fines from swelling clay to reduce formation damage caused by solids, clay swelling, or fines migration. A brine system may be selected to achieve a suitable density for use in a particular well-drilling operation. One advantage of using brines is that for a formation that is found to interact adversely with one type of brine, there is often another type of brine available with which that formation will not interact adversely. Typically, brines are selected from halide salts of mono- or divalent cations, such as sodium, potassium, calcium, and zinc. Chloride-based brines of this type have been used in the petroleum industry for over 50 years and bromide-based brines, for at least 25 years. Formate-based brines, however, have only been widely used in the industry relatively recently (roughly the past ten years).

Cesium formate, which is a particular formate that has been more recently used in drilling and completion fluids, may be used as a solids-free base fluid. Cesium formate is the densest of the clear alkali formate fluids, having a specific gravity of 2.3 (density of 19.2 pounds per gallon). Because of this intrinsic high density, the necessity of weighting agents, such as barium sulfate, which can damage tools and the formation, can be eliminated. Other alkali formates, which are of lower density than cesium formate, and that are typically used in drilling and completion fluids include potassium formate and sodium formate. Lower density formates are often blended with cesium formate to produce a fluid having a specific gravity between 1.0 and 2.3.

Fluids containing cesium formate have been shown to increase production and improve drilling speeds, which can save time and reduce operating costs. Cesium formate has also been shown to be compatible with all major components of the drilling (BOP, surface equipment, MWD, LWD and mud motors) and completion equipment (metals and elastomers), under conditions of high temperature and pressure. The monovalent nature of cesium formate reduces the likelihood of reservoir formation damage, providing operators with good control and desirable lubricity downhole. Furthermore, alkali formates do not damage the producing formation or downhole metals as their corrosive alternatives (high-density brines) may do. Because it is biodegradable as well as non-corrosive, cesium formate is considered an environmentally safer product than other drilling fluids on the market.

However, despite the desirable performance that results from drilling a well with cesium formate, there are effective limitations on its use. A fluid that includes cesium formate is relatively expensive, so the economics of drilling require that any available cesium formate be reclaimed and recycled. There are, however, limitations on reclamation processes, in terms of both maximum percentages of cesium formate reclaimed and economical feasibility.

Accordingly, there exists a continuing need for developments in reclamation processes for contaminated formate brines.

SUMMARY OF INVENTION

In one aspect, embodiments disclosed herein relate to a method of recovering formate from a halide-contaminated formate brine that includes mixing a formate recovery solvent and the halide-contaminated formate brine; separating halide contaminants from the formate; and recovering the formate from the formate recovery solvent.

In anther aspect, embodiments disclosed herein relate to a method of recovering formate brine from a halide-contaminated formate brine that includes mixing a formate recovery solvent and the halide-contaminated formate brine; filtering halide precipitants from the mixture of the formate recovery solvent and the formate brine; and distilling the mixture to recover the formate brine from the formate recovery solvent.

In yet another aspect, embodiments disclosed herein relate to a method of recovering formate from a halide-contaminated formate brine that includes mixing a formate recovery solvent and the halide-contaminated formate brine; extracting the formate into the formate recovery solvent; separating the formate recovery solvent comprising the formate from an aqueous phase comprising the halide contaminants; and distilling the formate and the formate recovery solvent to recover formate.

Other aspects and advantages of the invention will be apparent from the following description and the appended claims.

DETAILED DESCRIPTION

Figure 1:
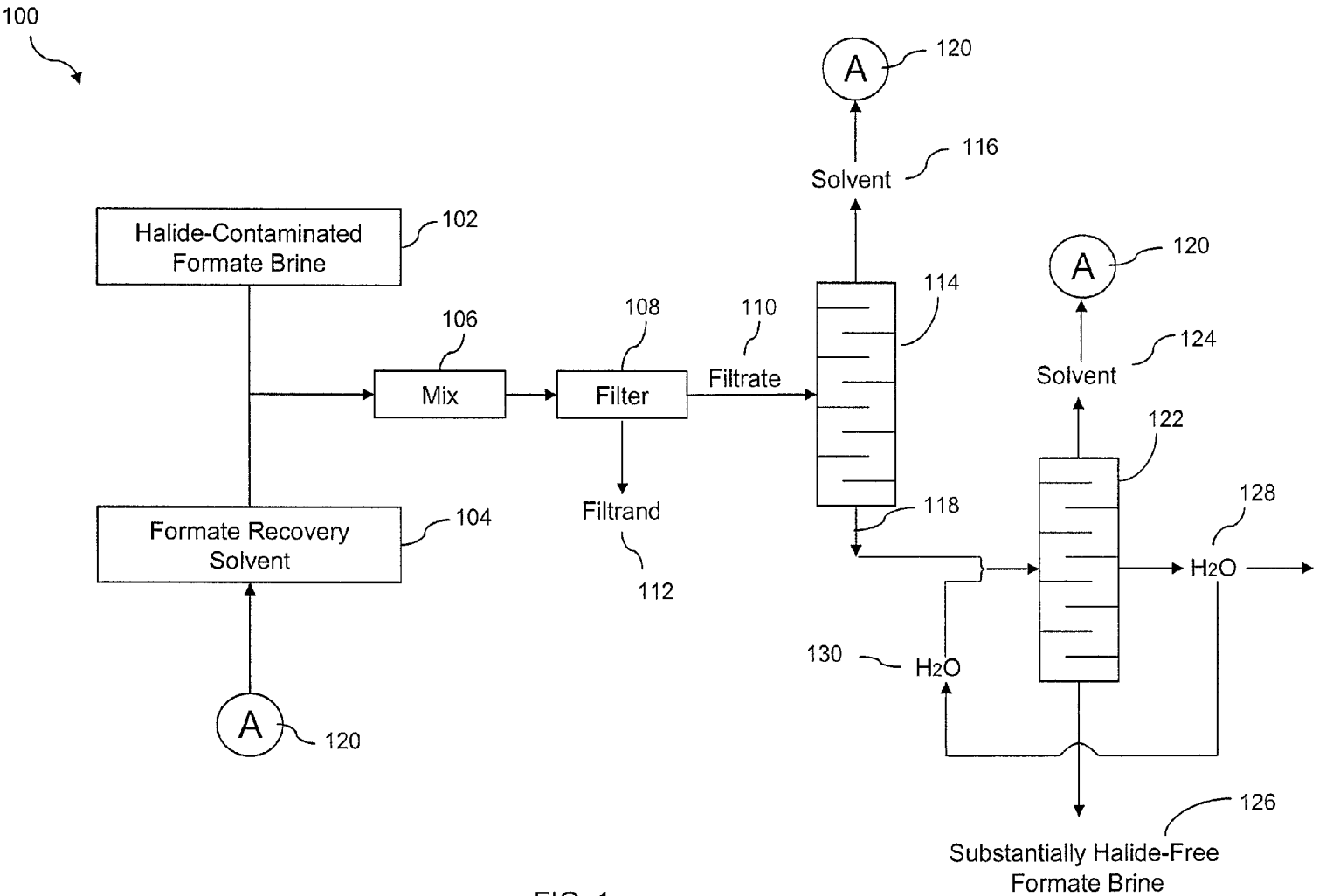
FIG. 1 is a simplified process flow diagram for reclaiming a formate brine, according to embodiments disclosed herein.

In one aspect, embodiments disclosed herein relate to spent wellbore fluids. More particularly, embodiments of the present disclosure relate methods to recover brine from a spent drilling fluid or other well servicing fluid.

For purposes of the present disclosure, brine is a term understood by those skilled in the art of drilling and oil recovery to refer to a salt solution of a particular density used as part of a wellbore fluid. Examples of brine include, but are not limited to, formate, acetate, and other carboxylates, chloride, bromide, iodide, tungstate, poly-tungtate, heteropolytungstate, carbonate, bicarbonate, or nitrate salts of ammonium, sodium, potassium, cesium, rubidium, lithium, calcium, magnesium, zinc, or barium, combinations and blends thereof. In a particular embodiment, the brines recovered from the wellbore fluids of the present disclosure, include, but are not limited to, cesium formate, potassium formate, cesium acetate, potassium acetate, and/or other cesium or potassium carboxylates, and the like.

Generally, when a wellbore fluid is used and recovered, the fluid will contain the brine as well as various additives, solids, and other debris that were brought up from the wellbore operation. Additionally, a wellbore fluid may contain other dissolved salts, such as halide salts, that may be present in the returned wellbore fluid for a variety of reasons. In recovering a brine, such as a formate brine, it may be desirable to remove other dissolved salts, such as halides, to recover a more pure brine. However, halides are known to be very difficult to remove from formate brine solutions due to their high solubility. The inventors of the present disclosure have determined that by preferentially removing at least a portion of halide contaminants present in a formate brine therefrom, a reclaimed formate brine wherein the content of halide salts has been significantly reduced may be obtained.

Preferential removal of halide salts, in a particular embodiment, may be achieved by using a formate recovery solvent to separate out halide contaminants. As used herein, the term "formate recovery solvent" refers to a solvent having a high capacity to dissolve formate salts, but little capacity to dissolve halide salts. Examples of such solvents include polar, non-aqueous solvents, such as, for example various lactams (cyclic amide), lactones (cyclic ester), or other solvents known in the art. In one embodiment, such 5- or 6-membered lactams and lactones may be used. In a particular embodiment, 2-pyrrolidone or N-hydrocarbyl-2-pyrrolidone may be used. While N-hydrocarbyl-2-pyrrolidone may include an alkyl, aryl, or alkaryl group ranging from 1 to 10 carbons in length, exemplary examples of solvents suitable for use in the reclamation process of the present disclosure include N-methylpyrrolidone and N-octylpyrrolidone.

Thus, by contacting a formate recovery solvent with a halide-contaminated brine, separation of the halide salts may be achieved. Depending on the solvent selected, and its miscibility with water, the halide salts may either be precipitated out of solution or halide salts and formate salts partitioned into two immiscible liquids. Thus, once the halide-contaminated formate brine is mixed with a formate recovery solvent, at least one separation technique may be used assist in the recovery of a more pure formate. Typical separation techniques known to those skilled in the art include filtration, liquid-liquid extraction, evaporation, distillation, fractional distillation, fractional crystallization and centrifugation, etc. However, one of ordinary skill in the art would appreciate that multiple techniques may be used in combination.

In a particular embodiment, a combination of filtration (i.e., liquid-solid separator) or a separatory funnel (or other liquid-liquid separator) and fractional distillation may be used to reclaim a halide-contaminated brine in accordance with the present disclosure. Referring to FIG. 1, a process flow diagram for reclaiming a formate brine, according to embodiments disclosed herein, is shown. In process 100, a halide-contaminated formate brine 102 is mixed 106 with a formate recovery solvent 104. In the embodiment shown in FIG. 1, the mixture of halide-contaminated formate brine 102 and formate recovery solvent 104 results in precipitation of halide salts due to the low capacity for dissolution of halide salts of formate recovery solvent 104. Thus, to remove precipitated halide salts from the mixture 106, mixture 106 is filtered 108 such that formate brine and formate recovery solvent are present in filtrate 110, while halide salts, such as NaCl, NaBr, KCl, KBr, CsCl, CsBr, $CaCl_2$, etc., remain as filter cake or filtrand 112, especially if the degree of halide-salt contamination is relatively high. Filtrate 110 is then fed to a fractionating column 114.

Fractionating column 114 may be used to supply a temperature gradient over which the distillation of filtrate 110 fed into column 114 can occur. In using distillation, formate brine and formate recovery solvent may be separated as two liquids with different boiling points. As the mixture of the two liquids is heated, the vapors that are recovered will be richest in the components of the mixture that boil at the lowest tray temperature, including the formate recovery solvent. On entering the column, the feed starts flowing down but the part of the feed richer in lower boiling component(s), e.g., the formate recovery solvent, vaporizes and rises. However, as it rises, it cools and condenses on the column's plates or packing. As vapors continue to rise through the column, the liquid that has condensed will revaporize. Each time this occurs the resulting vapors are more and more concentrated in the more volatile substances. Formate recovery solvent, which is the "lightest" fluid (those with the lowest boiling point or highest volatility) exits from the top of the columns as overhead 116 and the formate brine, which is "heaviest" component products (those with the highest boiling point) exits from the bottom of the column as bottoms 118. The formate recovery solvent collected as overhead 116 may be recycled 120 for use in further reclamations.

However, one of ordinary skill in the art would appreciate that bottoms 118 may contain residual solvent therein, and thus, the bottoms 118 may be fed into a second fractionating column 122 for additional distillation/purification. Similar to as described above, formate recovery solvent, which is the "lightest" fluid, exits from the top of the columns as the overhead 124 and the formate brine, which is "heaviest" component product, exits from the bottom of the column as the bottoms 126. Further, one of ordinary skill in the art of separations would appreciate that any number of distillations or other separations may additionally be performed or variations in the general distillation process may be made to more effectively or efficiently separate the formate recovery solvent from the formate brine. Ideally, bottoms 126 produced from the last distillation column, or from the last separation, should contain a substantially halide-free formate brine 126 that is also substantially free of formate recovery solvent.

Additionally, as shown in FIG. 1, in second fractionating column 122, a side draw of water 128 may optionally be taken. Water 128 may either be removed as waste 130 or recycled into feed 130 to adjust the water content of bottoms 126. Removal of water from the brine may also be desirable where the formate brine has taken on excess water during its use. Further, while not shown in FIG. 1, when bottoms 118 are drawn from fractionating column 114, additional precipitation of halide salts may occur, necessitating an additional filtration step prior to feeding bottoms 118 into second fractionating column 122.

Moreover, as described above, in some instances, mixture of a halide-contaminated brine with formate recovery solvent may result in immiscibility between water and the formate recovery solvent. In such an instance, mixing of the brine and formate recovery solvent may be used to separate the halide and formate salts based on their solution preferences for the two different immiscible liquids. That is, the formate recovery solvent may be selected such that formate has a greater affinity (or partition coefficient) for the solvent as compared to water, thus extracting the formate salts from water to the solvent. Separation of the two immiscible liquids may be achieved using separatory funnels (or other liquid-liquid separators). Further, one of ordinary skill in the art would appreciate that to more effectively extract formate from the aqueous phase, it may be desirable to perform multiple extractions. The formate-solvent mixture may then be subjected to additional separations, such as distillation separation or vaporization, to remove the solvent from the formate.

Figure 2:
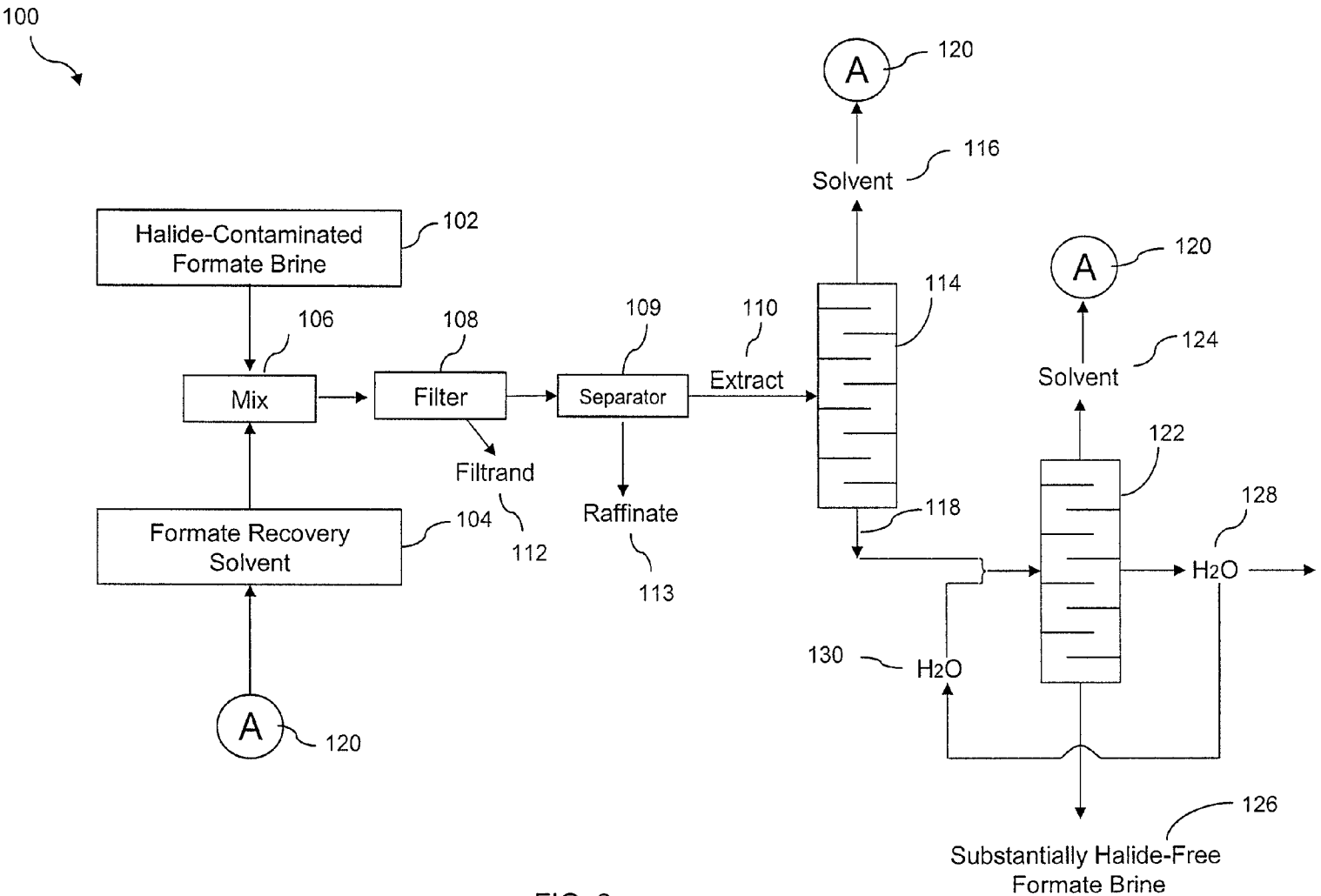
FIG. 2 is a simplified process flow diagram for reclaiming a formate brine, according to embodiments disclosed herein.

Referring to FIG. 2, a process flow diagram for reclaiming a formate brine, according to other embodiments disclosed herein, is shown. In process 100, a halide-contaminated formate brine 102 is mixed 106 with a formate recovery solvent 104. In the embodiment shown in FIG. 1, the mixture of halide-contaminated formate brine 102 and formate recovery solvent 104 results in precipitation of halide salts due to the low capacity for dissolution of halide salts of formate recovery solvent 104. Thus, to remove precipitated halide salts from the mixture 106, mixture 106 is filtered 108 to remove halide salts, such as NaCl, NaBr, KCl, KBr, CsCl, CsBr, $CaCl_2$, etc., remain as filter cake or filtrand 112. If the contamination by halide salts in the brine being reclaimed is low, there may be little or no filter cake or filtrand to recover. Therefore, a liquid-liquid separation 109 is then performed on the mixture resulting in raffinate 113 and extract 110 in order to separate more of the low-concentration halides into the raffinate relative to those in the extract. Additionally, a liquid-liquid separation may also be desirable when the concentration of halide salts in the brine is high. In such an instance, filtration may remove those salts that precipitate out of solution, and any remaining halides may be concentrated into the raffinate relative to the extract. Further, one of ordinary skill in the art would appreciate that to more effectively extract formate from the aqueous phase, it may be desirable to perform multiple extractions or perform the extractions in a conventional continuous cascading process. Extract 110 is then fed to a fractionating column 114.

Fractionating column 114 may be used to supply a temperature gradient over which the distillation of filtrate 110 fed into column 114 can occur. In using distillation, formate brine and formate recovery solvent may be separated as two liquids with different boiling points. As the mixture of the two liquids is heated, the vapors that are recovered will be richest in the components of the mixture that boil at the lowest tray temperature, including the formate recovery solvent. On entering the column, the feed starts flowing down but the part of the feed richer in lower boiling component(s), e.g., the formate recovery solvent, vaporizes and rises. However, as it rises, it cools and condenses on the column's plates or packing. As vapors continue to rise through the column, the liquid that has condensed will revaporize. Each time this occurs the resulting vapors are more and more concentrated in the more volatile substances. Formate recovery solvent, which is the "lightest" fluid (those with the lowest boiling point or highest volatility) exits from the top of the columns as overhead 116 and the formate brine, which is "heaviest" component products (those with the highest boiling point) exits from the bottom of the column as bottoms 118. The formate recovery solvent collected as overhead 116 may be recycled 120 for use in further reclamations.

However, one of ordinary skill in the art would appreciate that bottoms 118 may contain residual solvent therein, and thus, the bottoms 118 may be fed into a second fractionating column 122 for additional distillation/purification. Similar to as described above, formate recovery solvent, which is the "lightest" fluid, exits from the top of the columns as the overhead 124 and the formate brine, which is "heaviest" component product, exits from the bottom of the column as the bottoms 126. Further, one of ordinary skill in the art of separations would appreciate that any number of distillations or other separations may additionally be performed or variations in the general distillation process may be made to more effectively or efficiently separate the formate recovery solvent from the formate brine. Ideally, bottoms 126 produced from the last distillation column, or from the last separation, should contain a substantially halide-free formate brine 126 that is also substantially free of formate recovery solvent.

Additionally, as shown in FIG. 1, in second fractionating column 122, a side draw of water 128 may optionally be taken. Water 128 may either be removed as waste 130 or recycled into feed 130 to adjust the water content of bottoms 126. Removal of water from the brine may also be desirable where the formate brine has taken on excess water during its use. Further, while not shown in FIG. 1, when bottoms 118 are drawn from fractionating column 114, additional precipitation of halide salts may occur, necessitating an additional filtration step prior to feeding bottoms 118 into second fractionating column 122.

Moreover, as described above, in some instances, mixture of a halide-contaminated brine with formate recovery solvent may result in immiscibility between water and the formate recovery solvent. In such an instance, mixing of the brine and formate recovery solvent may be used to separate the halide and formate salts based on their solution preferences for the two different immiscible liquids. That is, the formate recovery solvent may be selected such that formate has a greater affinity (or partition coefficient) for the solvent as compared to water, thus extracting the formate salts from water to the solvent. Separation of the two immiscible liquids may be achieved using separatory funnels (or other liquid-liquid separators). Further, one of ordinary skill in the art would appreciate that to more effectively extract formate from the aqueous phase, it may be desirable to perform multiple extractions. The formate-solvent mixture may then be subjected to additional separations, such as distillation separation or vaporization, to remove the solvent from the formate.

Further, while the above describes removing halide contaminants from a formate brine, one of ordinary skill in the art would appreciate that for a returned wellbore fluid, it may be necessary to remove additional additives from the wellbore fluid prior to reuse. For example, it may desirable to remove viscosifying additives and solid particles from the fluid prior to recovery of the formate brine as disclosed herein. Such removal of viscosifying additives and solid particles may be achieved using a process such as that described in U.S. patent application Ser. No. 12/671,711 entitled "Reclamation of Formate Brines" filed concurrently herewith, which is assigned to the present assignee and herein incorporated by reference in its entirety, or may include other techniques known to those skilled in the art.

EXAMPLES

A halide-contaminated cesium/potassium brine was subjected to a reclamation in accordance with embodiments of the present disclosure. Prior to treatment, a salt analysis was performed on the contaminated brine, the results of which are shown below in Table 1.

TABLE 1

| | |
|---|---|
| Specific Gravity | 2.0 |
| pH | 10 |
| $Ca^{+2}$ | <0.01% |
| $Mg^{+2}$ | <0.01% |
| $Zn^{+2}$ | <0.01% |
| $Na^{+}$ | <0.01% |
| $K^{+}$ | 11.7% |
| $Cs^{+}$ | 45.3% |
| $Fe^{+2,3}$ | 71 mg/kg |
| $HCOO^{-}$ | 22.5% |
| $Cl^{-}$ | 0.21% |
| $Br^{-}$ | <0.01% |

One liter of contaminated brine was mixed with 50 mL N-methylpyrrolidone, and a liquid-liquid extraction was carried out, setting aside the extract. Into the raffinate from this first liquid-liquid extraction, an additional 50 mL of N-methyl pyrrolidone was mixed, and again the second extract was set aside. The extraction process was repeated a third, fourth, and fifth time, and the five samples of extract were combined and placed in a roto-vap apparatus. Then, the solvent was removed from this extract in a roto-vap distillation apparatus, leaving behind a dry solid concentrate. To analytically determine the components extracted, a water solution of the dried extract was formed by dissolving the dried extract in an arbitrary quantity of water (15 mL). Due to the re-dissolution, the analysis of the extract was normalized to the same relative cesium content. The normalized data for the extract, as shown in Table 2 below, shows that the extract brine is significantly enriched in cesium relative to potassium, and depleted in iron and chloride.

TABLE 2

| | |
|---|---|
| Specific Gravity | 2.2[a] |
| pH | 8.4 |
| $Ca^{+2}$ | — |
| $Mg^{+2}$ | — |
| $Zn^{+2}$ | — |
| $Na^{+}$ | — |
| $K^{+}$ | 3.1% |
| $Cs^{+}$ | (45.3%) |
| $Fe^{+2,3}$ | 12 mg/kg |
| $HCOO^{-}$ | 19.1% |
| $Cl^{-}$ | 0.12% |
| $Br^{-}$ | — |

[a]estimated

The comparison, again, showing that the extract brine is significantly enriched in cesium relative to potassium, and depleted in iron and chloride, may be facilitated by combining Tables 1 and 2 into Table 3, below:

TABLE 3

| | | |
|---|---|---|
| Specific Gravity | 2.0 | 2.2[a] |
| pH | 10 | 8.4 |
| $Ca^{+2}$ | <0.01% | — |
| $Mg^{+2}$ | <0.01% | — |
| $Zn^{+2}$ | <0.01% | — |
| $Na^{+}$ | <0.01% | — |
| $K^{+}$ | 11.7% | 3.1% |
| $Cs^{+}$ | 45.3% | (45.3%) |
| $Fe^{+2,3}$ | 71 mg/kg | 12 mg/kg |
| $HCOO^{-}$ | 22.5% | 19.1% |
| $Cl^{-}$ | 0.21% | 0.12% |
| $Br^{-}$ | <0.01% | — |

[a]estimated

Advantageously, embodiments of the present disclosure provide for at least one of the following. By preferentially solubilizing or extracting formates from a halide-contaminated brine, a formate brine, such as a costly cesium or potassium brine, may be reclaimed for future use in wellbore applications, reducing costs associated with formate brines (particularly cesium formate). Further, by recycling the solvents used in the formate reclamation process, the reclamation may be achieved more efficiently or more economically, allowing for significant reductions in cost. Further, excess water may be removed from the fluid, allowing a more saturated formate brine to be obtained.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method of recovering formate from an aqueous halide-contaminated formate brine, comprising:

mixing a non-aqueous formate recovery solvent and the aqueous halide-contaminated formate brine, wherein the non-aqueous formate recovery solvent is selected from the group consisting of N-methylpyrrolidone, N-octylpyrrolidone, 2-pyrrolidone, 6-membered lactam, N-hydrocarbyl-2-pyrrolidone, wherein the hydrocarbyl group may include an alkyl, aryl, or alkaryl group ranging from 1 to 10 carbons in length, 5- or 6-membered lactones, and combinations thereof;

extracting the formate into the recovery solvent;

separating the formate recovery solvent from the aqueous halide-contaminated formate brine; and recovering the formate from the formate recovery solvent.

2. The method of claim 1, further comprising filtering halide precipitants from the mixture of the formate recovery solvent and the formate brine.

3. The method of claim 1, wherein the recovering the formate from the formate recovery solvent comprises distilling the formate and the formate recovery solvent.

4. The method of claim 1, further comprising:

recycling the separated formate recovery solvent to mix with additional halide-contaminated formate brine.

5. The method of claim 1, wherein the formate recovery solvent comprises a polar solvent.

6. The method of claim 5, wherein the formate recovery solvent comprises at least one lactam or lactone.

7. The method of claim 6, wherein the formate recovery solvent comprises N-alkyl-2-pyrrolidone.

8. The method of claim 7, wherein the formate recovery solvent comprises at least one of N-methyl-pyrrolidone and N-octyl-pyrrolidone.

9. The method of claim 1, wherein the recovered formate comprises at least one of cesium formate and potassium formate.

10. A method of recovering formate from an aqueous halide-contaminated formate brine, comprising:

mixing a non-aqueous formate recovery solvent and the halide-contaminated formate brine, wherein the non-aqueous formate recovery solvent is selected from the group consisting of N-methylpyrrolidone, N-octylpyrrolidone, 2-pyrrolidone, 6-membered lactam, N-hydrocarbyl-2-pyrrolidone, wherein the hydrocarbyl group may include an alkyl, aryl, or alkaryl group ranging from 1 to 10 carbons in length, 5- or 6-membered lactones, and combinations thereof;

filtering halide precipitants from the mixture of the formate recovery solvent and the formate brine; and distilling the mixture to recover the formate brine from the formate recovery solvent.

11. The method of claim 10, wherein the formate recovery solvent comprises N-alkyl-2-pyrrolidone.

12. The method of claim 11, wherein the formate recovery solvent comprises at least one of N-methyl-pyrrolidone and N-octyl-pyrrolidone.

13. The method of claim 10, wherein the recovered formate brine comprises at least one of cesium formate and potassium formate.

14. A method of recovering formate from an aqueous halide-contaminated formate brine, comprising:

mixing a non-aqueous formate recovery solvent and the aqueous halide-contaminated formate brine, wherein the non-aqueous formate recovery solvent is selected from the group consisting of N-methylpyrrolidone, N-octylpyrrolidone, 2-pyrrolidone, 6-membered lactam, N-hydrocarbyl-2-pyrrolidone, wherein the hydrocarbyl group may include an alkyl, aryl, or alkaryl group ranging from 1 to 10 carbons in length, 5- or 6-membered lactones, and combinations thereof;

extracting the formate into the formate recovery solvent;

separating the formate recovery solvent comprising the formate from an aqueous phase comprising the halide contaminants; and distilling the formate and the formate recovery solvent to recover formate.

15. The method of claim 14, further comprising:

recovering the formate recovery solvent from the distilling as an overhead fraction; and recovering the formate from the distilling as a bottoms fraction.

16. The method of claim 14, wherein the formate recovery solvent comprises N-alkyl-2-pyrrolidone.

17. The method of claim 16, wherein the formate recovery solvent comprises at least one of N-methyl-pyrrolidone and N-octyl-pyrrolidone.

18. The method of claim 14, wherein the recovered formate comprises at least one of cesium formate and potassium formate.

* * * * *